US007762385B2

(12) United States Patent
Maeder et al.

(10) Patent No.: US 7,762,385 B2
(45) Date of Patent: Jul. 27, 2010

(54) CONVEYOR-TECHNOLOGY DEVICE

(75) Inventors: Carl Conrad Maeder, Hittnau (CH); Walter Reist, Hinwil (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 12/326,729

(22) Filed: Dec. 2, 2008

(65) Prior Publication Data

US 2009/0072474 A1 Mar. 19, 2009

Related U.S. Application Data

(63) Continuation of application No. 10/522,953, filed as application No. PCT/CH03/00522 on Jul. 30, 2003, now Pat. No. 7,516,839.

(51) Int. Cl.
*B65H 39/06* (2006.01)

(52) U.S. Cl. ..... 198/778; 270/52.07; 270/52.16

(58) Field of Classification Search ..... 198/778, 198/680; 270/52.07, 52.16, 58.01
See application file for complete search history.

(56) References Cited

U.S. PATENT DOCUMENTS

| | | | | | |
|---|---|---|---|---|---|
| 4,058,202 | A * | 11/1977 | Reist et al. | ..... | 198/470.1 |
| 4,408,755 | A * | 10/1983 | Meier | ..... | 270/52.09 |
| 4,681,310 | A * | 7/1987 | Cooper | ..... | 270/58.15 |
| 4,811,938 | A * | 3/1989 | Hansch | ..... | 270/52.27 |
| 5,094,438 | A * | 3/1992 | Reist et al. | ..... | 270/52.3 |
| 5,305,994 | A * | 4/1994 | Matsui et al. | ..... | 270/58.13 |
| 5,551,680 | A * | 9/1996 | Ohmichi et al. | ..... | 270/58.08 |
| 5,660,382 | A * | 8/1997 | Meier | ..... | 270/52.16 |
| 6,446,953 | B1 * | 9/2002 | Felix et al. | ..... | 270/52.19 |
| 6,690,996 | B2 * | 2/2004 | Seiler | ..... | 700/228 |
| 7,516,839 | B2 * | 4/2009 | Maeder et al. | ..... | 198/778 |

FOREIGN PATENT DOCUMENTS

| | | |
|---|---|---|
| CH | 584 153 | 1/1977 |
| CH | 667 621 | 10/1988 |
| EP | 0 095 603 A1 | 12/1983 |
| EP | 0 218 872 A2 | 4/1987 |
| EP | 0 354 343 A1 | 2/1990 |
| EP | 0 771 745 A1 | 5/1997 |
| EP | 0 828 190 A1 | 3/1998 |
| EP | 1 153 872 A2 | 11/2001 |
| EP | 1 254 857 A2 | 11/2002 |
| WO | WO 02/36474 A1 | 5/2002 |
| WO | WO 02/057164 A1 | 7/2002 |

* cited by examiner

*Primary Examiner*—David H Bollinger
(74) *Attorney, Agent, or Firm*—Pauley Petersen & Erickson

(57) ABSTRACT

The invention relates to a method as well as to a conveyor-technology device for processing printed products. The conveyor-technology device includes a guide and conveyor which may be moved along the guide, for conveying printed products which are fed by way of feeders. The guide is curved in several spatial directions. The conveyor-technology device includes a holding device which serve for the temporary fixing of printed products in a manner such that these at least in regions may be conveyed against gravitational force.

2 Claims, 7 Drawing Sheets

CONVEYOR-TECHNOLOGY DEVICE

CLAIM OF PRIORITY

This application is a Continuation of U.S. patent application Ser. No. 10/522,953, filed 9 Feb. 2006. U.S. application Ser. No. 10/522,953 makes reference to, incorporates, and claims all benefits accruing under Title 35 U.S. Code §365(c) of PCT International application entitled CONVEYER-TECHNOLOGY DEVICE, filed on 30 Jul. 2003 and duly assigned Serial No. PCT/CH03/00522.

BACKGROUND OF THE INVENTION

1. Field of the Invention

The invention relates to a method for manufacturing multi-part printed products according to the preamble of the independent patent claims.

2. Description of the Related Art

A means for collecting folded printed products is known from EP 0 095 603. This comprises a multitude of saddle-like rests which are arranged in the manner of a ladder rung on two parallel conveyor chains which in each case revolve in a vertical plane. Several supply locations are arranged one after the other along the upper face which is effective in conveying, on which printed sheets are deposited astride the rests, wherein the printed sheet which is deposited last forms the outer part of the end product. At the end of the conveyor path, the end products are removed at a removal location and conveyed away. The saddle-like rests which are provided for the processing are directed vertically upwards.

A means for collating products is known from EP 0 218 872. This comprises a multitude of pocket-like receiver parts which are arranged transversely to the revolving direction on a conveyor chain revolving in a plane in the manner of a carrousel. Several supply locations are provided along the effective conveying path, at which the printed products are introduced into the receiver parts. At the end of the effective conveying path, the printed products which are thus collated together into a multi-part end product and arranged next to one another in the receiver parts are transferred to a station for further processing by way of opening the base of the receiver parts. The collated printed products do not have a folded outer part within which the other printed products, the inner parts, are arranged.

Drum-like collector means are known from the state of the art. With these, a printed product is supplied at supply locations which in each case are mutually offset in the axial direction of the drum. During a revolution of the drum, the printed product is conveyed forwards to the subsequent supply location where a further printed product is inserted into a preceding one or is applied astride this. The printed products at a subsequent removal location are finally removed from the drum and where appropriate are led to further processing steps.

Such a drum-like means for the insertion of printed products is for example known from CH 584 153. At a first supply location, a first folded printed product with its fold in front is inserted into a pocket-like receiver part of the drum-like means which may be indicated as a collector drum or cell wheel. In the course of a revolution of the collector drum, the printed product is opened and by way of displacement elements controlled by slotted guides, are conveyed to the next supply locations which are arranged offset in the axial direction. At this supply location, a further, folded printed product is inserted into the first opened printed product, wherein in each case the inserted printed products come to lie side by side. Further printed products are inserted at further supply locations located downstream. The end products which are formed in such a manner have a firstly supplied outer part and at least one inner part which is inserted therein. Each cell of the collector drum comprises displacement elements which are controlled by slotted guides and which are allocated to it, for moving the inserted printed products forwards. The printed products on their way from supply location to supply location, by way of the superposition of the longitudinal movement and the rotation of the drum, are guided on an essentially spiral or helical path along the collector drum. Since the individual printed products pass practically the whole length of the cells, the cells may have no interruption.

A method and a device for manufacturing multi-part printed products are known from EP 0 354 343, with which an outer part, at the end of a not exclusively collection procedure is applied astride a variable inner part with the open side edge ("cut-edge side") in front. The device disclosed there comprises receiver parts with a base and with lateral support members which project slightly beyond the side edge of the inner parts, as well as supply locations for outer parts and one or more inner parts, wherein the supply location for the outer part is designed such that the outer part may be applied astride the inner part with the cut-edge side in front. The receiver parts with a drum-like embodiment comprise pocket-like compartments with separating separation walls. Each receiver part comprises a transport element which acts in the longitudinal direction of the receiver parts and by way of a temporary gripping conveys the inner parts and/or the outer part further to the next respective supply location or removal location. The printed products are guided along the drum on a spiral or helical movement path by way of displacement elements controlled by slotted guides.

A collecting device is known from CH 667 621 which proceeds from the "washing line" principle. Folded printed products with their end-face in the conveyor direction are deposited onto rotating collector paths by way of feeder stations. The printed products are conveyed along a collector path by way of catches. In order to obtain a certain conveyor performance, several collector paths need to be arranged next to one another which rotate about an axis, which leads to a relatively complicated construction.

EP 0 771 745 shows a device for gathering two-dimensional products. The device along a conveyor member comprises carrier elements revolving in a plane in the manner of a carrousel. The carrier elements are arranged at an acute angle with respect to the revolving direction of the conveyor member. Two-dimensional products are transferred to the carrier elements by way of suitably arranged supply means. Since the conveyor direction of the supply means does not correspond to the revolving direction of the conveyor member, the two-dimensional products on transfer undergo a deflection in the lateral direction.

PCT/CH01/00643 (CH2000 2139/00) shows a device for processing two-dimensional objects, in particular printed products, with decoupled conveyor elements which may be moved individually of one another. The device comprises a rail system arranged essentially in one plane, along which individual conveyor elements are freely movable behind one another. Each conveyor element comprises a carrier element arranged in the manner of a cantilever, with a vertically upwardly directed saddle on which printed products deposited thereon held by gravity are transported. The printed products are fed by way of stations which are arranged linearly behind one another. Although the rail system may comprise certain gradients, e.g. a head-over conveying of the products is not possible since no suitable holding means are provided.

SUMMARY OF THE INVENTION

The devices known from the state of the art which are based on a collector drum, although being of a particularly high performance, however have a relatively complicated, rigid construction. Devices with vertically directed saddles which revolve in the manner of a ladder rung or carrousel, due to their principle have a spatially intensive construction or a low conveying density.

With devices for gathering (Sammeln), collecting (Zusammentragen) or inserting (Einstecken) printed products which are designed for high outputs, nowadays systems which are based on drums have asserted themselves, with which the printed products during the processing are guided on spatial, essentially spiral or helical movement paths. These spiral or helical movement paths, with regard to the devices known from the state of the art, are produced by superimposing a rotational movement with a translatory movement. The spatial movement paths allow the printed products to be processed to be fed by conveying essentially perpendicular to the axial direction of the drum by way of feed conveyors arranged next to one another. The superiority of devices based on this principle amongst other things is due to the fact that on transfer of the printed product to the cell wheel, these products are not subjected to an abrupt change of direction, and they are processed in a continuous manner. By way of this, even with high processing speeds, these is sufficient time in order to feed convey the printed products to be processed. The high output density of these devices is achieved by way of the fact that the printed products are moved along the drum on an essentially spiral or helical path transversely to their side edges. A relatively complicated design is however required for the movement in the peripheral direction as well as in the axial direction of the drum. The oscillation and mounting problems which occur beyond a certain shaft length furthermore lead to a limited constructional length.

It is the object of the invention to provide a device for gathering, collating or inserting printed products which has a simple construction and a high performance.

The object is achieved by the invention as is defined by the characterising part of the independent patent claims.

The invention disclosed here, apart from an extremely simple construction offers the advantage that printed products may be guided on spatially curved, spiral or helical paths which are optimised for the processing. The paths are curved in several spatial directions and when required are rotated about themselves so that the printed products are simultaneously rotatable about the longitudinal axis of the path. Extremely compact devices may be realised by way of the invention, which offer a maximum of flexibility and a high processing density. In contrasts those disadvantages which prevail with the state of the art based on collector drums are avoided, specifically the relatively complicated design and, as a result of the complicated mounting, the limited length. The invention offers the possibility of replacing existing installations at least partly by way of imitating their functionality.

Specially designed conveyor means which serve for gathering, collating and/or inserting printed products at least in a processing region are guided by way of suitably designed guide means along movement paths which are curved spatially in several spatial direction and are closed or opened, in several planes. The device according to the invention is designed such that the printed products are capable of being conveyed against gravity that is to say head-over. For this purpose the conveyor means comprise holding means or cooperate with these. With regard to the holding means it is the case for example of blocking or clamping elements (flaps, clips, clamps, holding arms) which in a targeted manner prevent the printed products located in the region of the device from falling out. The printed products during the revolving have a variable alignment to one another or however they are aligned parallel to one another at least in sections. Alternatively or supplementary to this one may apply external holding means, i.e. holding means which are not part of a conveyor means. Here it is the case e.g. of endlessly revolving tensioning belts or suitably arranged lead plates or guide plates.

The guide means preferably have a modular construction and are actively connected to one another via standardised interfaces or switches (points) which may be changed over. The conveyor means on their way along the movement paths have a given or variable distance to one another and, depending on the embodiment form, are coupled with a positive fit or friction fit in a direct or indirect manner via a drive means.

The conveyor means which are moved along a guide means, accordingly comprise a suitably designed carrier element, a clamp or gripper, pocket, saddle or a combination of these. The conveyor means are preferably designed such that they simultaneously or alternatively permit a gathering, collating, insertion or stapling/stitching. The conveyor means as a rule contain a plate element and/or a saddle which serve for carrying folded printed products. One embodiment of conveyor means contains pockets which in particular serve for inserting or collating the printed products. A further embodiment of conveyor means contains a rim which serves for collecting and for supporting printed products. The conveyor means as a rule are fed vertically or horizontally. In the case that these are required, holding means are provided which prevent the fed products from falling out.

Suitably designed rails or channels are suitable as guide means. The conveyor means are guided or driven at one or more sides along the movement paths which are curved spatially in several planes and which are defined by the rails or channels. It is not ruled out for the guide means at least regionally to have no curvature or to be curved in only one spatial direction. Instead of only one, where required, at least along certain sections one may also provide several guide means which support, guide or take-over the conveyor means on several sides. On account of this there exists e.g. the possibility of accommodating high processing forces or of ensuring a particularly precise guiding.

The conveyor means themselves, if required, have a changeable geometry or alignment so that they may be set in distance and alignment with respect to the guide means, and/or may be applied largely independently of the format, and/or for opening folded printed products, e.g. by way of lateral insertion.

By way of guide means which at least in regions are designed in a spiral or helical manner, the conveyor means and thus the printed products are guided on spatial paths in several planes. By way of a suitable design of the guide means, there further exists the possibility of aligning the conveyor means about the longitudinal axis of the guide means so that there results further functional movement patterns with an alignment which is optimal for the process. In particular with acute changes of direction it is advantageous to move the conveyor means on the outer side of the radius. When required, the conveyor means are adjustably arranged about at least one further axis with respect to the guide means. In the transfer region of a feeder, the conveyor means are aligned such that they encourage an opening of a folded printed product.

The charging of the conveyor means is preferably effected in more than one plane. The invention, by way of a suitable design and arrangement of the guide means, provides the possibility of a variety of movement paths optimised to the respective application. There exists the possibility of the movement paths of the guide means to exactly imitate the movement paths of the printed products known from cell wheels, so that conventional devices may be substituted in a simple manner. Furthermore there exists the possibility of designing the movement path in the form of an ovalised or regionally flattened spiral. Moreover there exists the possibility of designing the spiral with a constant or variable pitch and radius so that a variety of processing steps is possible by way of the same device, or a device which is based on the same functioning principle.

The conveyor means which are moved along the guide means are fed with printed products from below, from above or from the side. The collected printed products when required are stitched/stapled in the region of a spiral or in a section lying on the outside. For this purpose the conveyor means if required comprise active or passive bend-up means for staples. The guide means for this purpose has a straight, concave or convex design which is matched to the path of the stapling device (staple heads).

Suitably designed flexible or rigid guide channels have been proven to be favourable as guide means, in which the guide means are driven with a positive fit or with a friction fit by way of abutment, pulling or their own drive. The cross section of the guide channels, guide rails is preferably designed with one or more cells, and when required along at least one edge or surface comprises a gap-like opening which serves for interaction with a drive means located in the inside of a channel. The conveyor means with certain embodiments comprise a bearing means (inner runner) arranged in the inside of the guide channel which is designed such that the guide means is displaceable at least in the longitudinal direction of the guide channel. With other embodiments with rail-like guide means, the bearing means encompasses the guide means at least regionally (outer runner). The bearing means comprise roller bearings, ball bearings or sliding bearings and may be actively connected to one another in a direct or indirect manner. When required, in sections or in its entirety, a revolving conveyor member is arranged in one of the channel cells, e.g. in the form of a chain or a cable which serves for continuously driving the conveyor means.

The guide means may be formed by a rail which has an essentially straight region along which the conveyor feed locations are arranged, and deflection regions where the conveyor means are deflected in order to be transferred to a return path or the straight region. The rail may also be spiral shaped and the return region may have a different geometry. Alternatively e.g. the counter body may have a double-helix-like structure, wherein the helix curves serve for the forward conveying, or however also one for the forward path and the other for the return path. The provision of a special return path may be avoided in that the conveyor elements are moved in a to-and-fro manner along their path, i.e. during a certain time interval execute a forward and then a return movement. In this case too, a double-helix-like path may offer advantages in that e.g. a compact constructional manner is achieved.

The device according to the invention offers the advantage that various devices which fulfil a variety of functions may be realised with comparatively few different components. By way of using the same elements repeatedly and in a targeted manner, the device is considerably simpler in manufacture and in maintenance.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
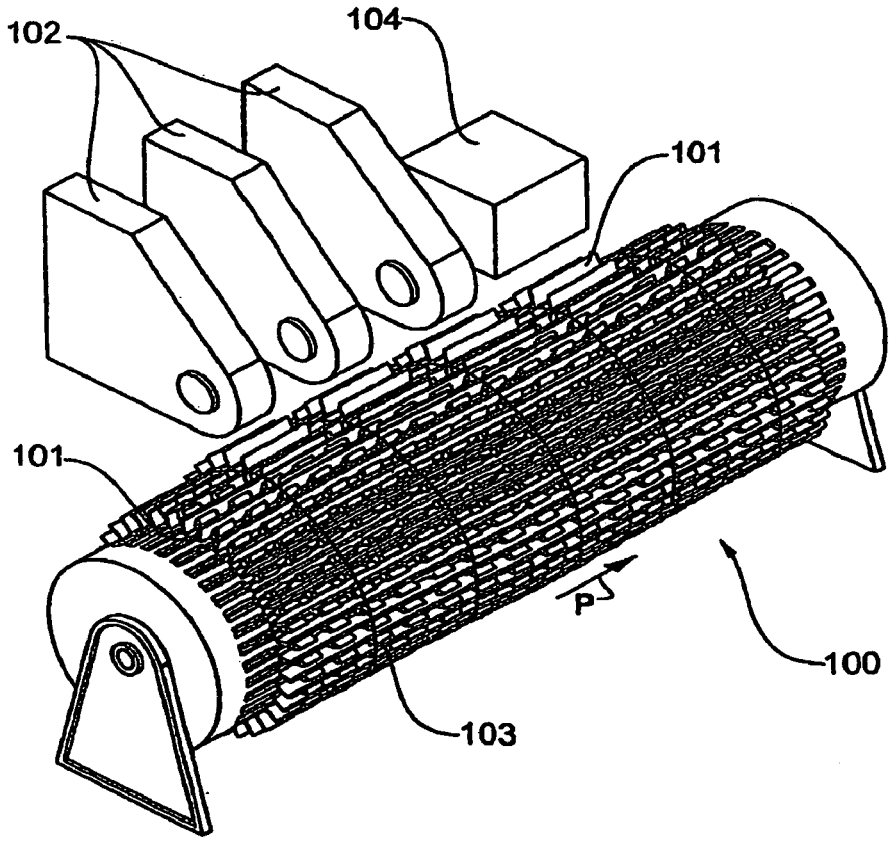
FIG. 1 (Prior Art)
FIG. 1 is a conventional device for gathering, collating or inserting printed products.

FIG. 1 shows a conventional device with a drum 100 for gathering, collating or inserting printed products. The drum 100 comprises saddles 101 distributed on its periphery which serve for the accommodation of printed products (not shown in more detail) which are fed by way of feed conveyors 102. The printed products deposited onto the saddles 100 are moved along the drum 100 from one feed conveyor 102 to the next feed conveyor 102 by way of displacing elements controlled by involute and arranged on or between the saddles 100. As a result of the rotational movement of the drum 100 and the movement of the products in the drum longitudinal direction superimposed on this, these during the processing procedure describe an essentially spiral or helical path 103 along the drum. At the end of the drum, the end product which consists of several printed products is removed and led away by way of a removal device. An additional working station 104, for example a conventional stationary or rotating binding apparatus is present in the rear section of this drum 100.

Figure 2:
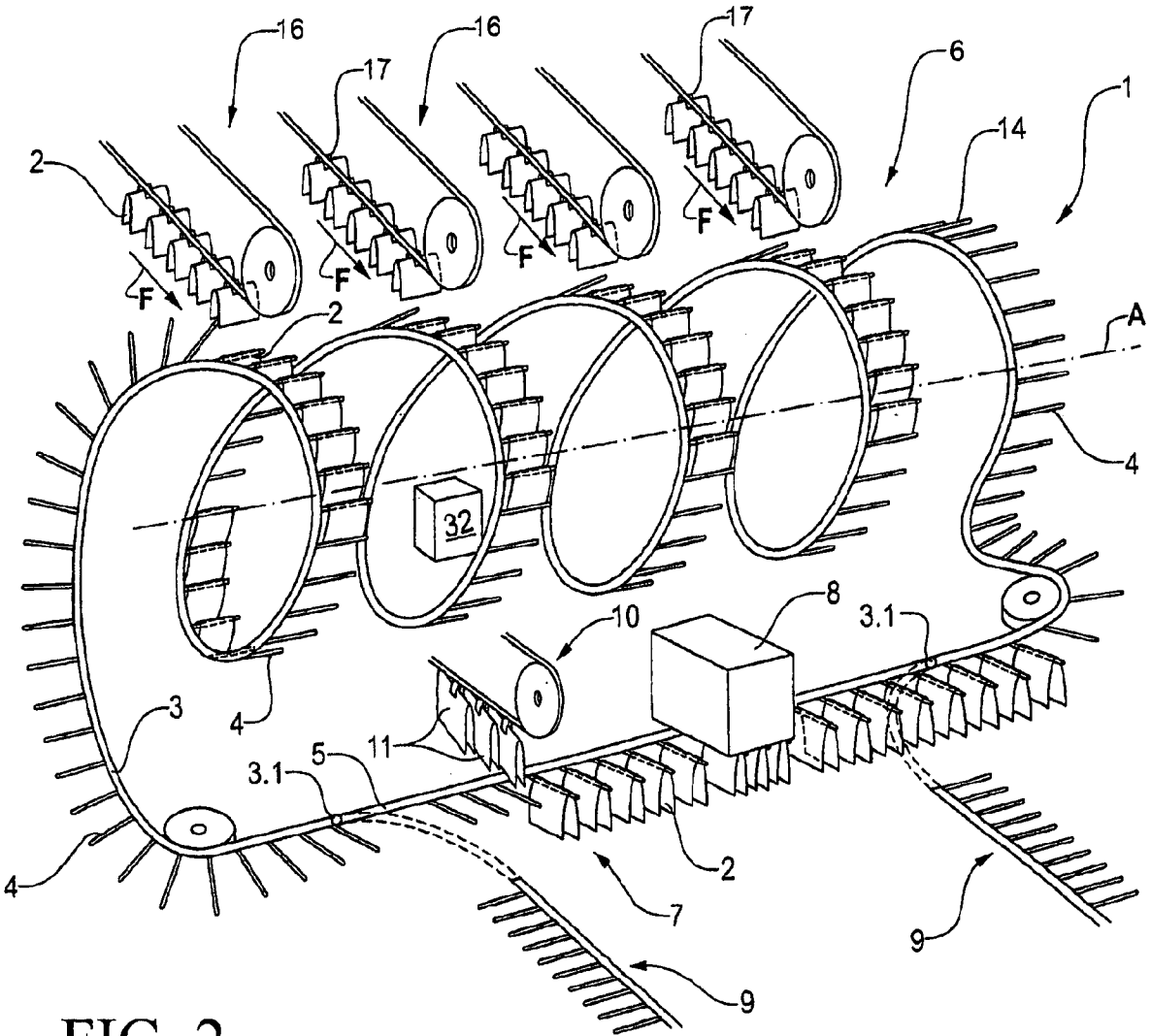
FIG. 2 is a first embodiment of a conveyor-technology device according to the invention.

FIG. 2 schematically shows one embodiment of a conveyor-technology device 1 for gathering, collating and/or inserting printed products 2, in a perspective representation. The conveyor-technology device 1 is suitable for processing printed products, in particular folded printed products.

Conveyor means 4 are arranged along a guide means 3 at a defined or variable distance. The conveyor means 4 comprise carrier elements 14 in the manner of a cantilever, which serve for receiving the printed products 2. The guide means 3 comprises an essentially spiral or helical section 6 which is curved in several spatial directions, whose ends are connected to one another in a closed circuit via an external return 7. The schematic axis of the helical section 6 is indicated with a dot-dashed line A. Alternatively the return may also be arranged in the inside of the spiral 6. By way of this, the device according to the invention offers the advantage than the space which previously was not available may be used. With conventional, drum-based devices, space in the inside of the drum is filled with components of the device and may not therefore be exploited. There exists the possibility of realising very compact, length-independent and robust devices with a simple construction. The oscillation problems which are disadvantageous of the state of the art are avoided. Instead of only one, when required, at least in regions, one may also arrange two spiral or helical sections next to one another or around one another, in order to define the angle and alignment of the conveyor elements.

The conveyor means 4 are driven along the guide means 3 by way of a drive means 5 acting on the whole periphery or only in sections. The direct or indirect transmission of the drive force of the conveyor means 4 is effected preferably by way of pulling or abutting. The conveyor means 4 for this purpose may be actively connected to one another in a direct or indirect manner. They are preferably the conveyor means 4 which are driven via revolving conveyor members 5, e.g. chains or cables. The at least one revolving conveyor member 5 acts on the whole periphery of the guide means 3 or only in sections. If required, switches (points) 3.1 are present which serve for actively connecting further guide means 9 or for the connection of external devices. The points (switch) 3.1 with the shown embodiment are arranged in the region of the return 7. If required, one may arrange interfaces in the region of the helical section, in particular between the individual loci of a helix so that an individualised continued processing is possible.

The conveyor means 4 serve for gathering, collating and/or inserting printed products 2. The printed products 2 for this purpose are fed in the conveyor direction F by way of feed conveyors 16 arranged in several planes which here are arranged facing one another in a parallel manner. The shown feed conveyors 16 comprise revolving chain links equipped with grippers 17 by way of which the printed products 2 are fed in a hanging manner and are transferred to the carrier elements 14 of the conveyor means 4. The term feed conveyor is to be understood in its broadest context. This means that of course, if suitable, other feed means may be used alternatively or in a supplementary manner, with which the printed products e.g. are conveyor fed individually, e.g. lying on a conveyor belt, or in the form of an imbricate flow. In the active region of the feed conveyor 16 a printed product 2 is transferred directly to the conveyor means 4, is inserted into previous printed products 2, is collated with such or gathered/deposited on such. The distance of the conveyor means 4 in the active region of the feed conveyor 16 corresponds to the distance of the supplied printed products 2 or is matched to this. Alternatively the distance of the grippers 17 may also be matched to the conveyor means 4. The conveyor means 4 are led in succession along the guide means 3 into the active region of the feed conveyors 16. The guide means 3 is designed such that the conveyor means 4 moved along the guide means 3 in the active region of the feed conveyors 16 have a direction which is optimally matched to the conveyor feed direction of the printed products. As may be recognised, the conveyor means 4 have a variable, location-dependent alignment with respect to the guide means 3.

The conveyor means 4 with the shown arrangement are held on one side. If required, at least in certain regions, they may be additionally mounted or guided in order to better accommodate large forces as occur on binding. Such an additional guiding is suitable for setting the distance between conveyor means.

With the shown embodiment the printed products 2 are supplied in the upper apex region of the helical section 6. Alternatively or supplementarily, the printed products 2 may also be supplied at another location. For insertion, for example the lower apex region of a helical section is suitable. For this, a suitable insertion device 32 is arranged radially inwards in the spiral section 6. The conveyor-technology device 1 has the advantage that amongst other things further processing steps are possible in the region of the return 7. With the device shown here a stapling/stitching device 8 is represented by way of example. In order to save space e.g. the stapling/stitching device 8 may also be arranged in the inside of the spiral 6. The end products 11 consisting of several printed products are removed and led away by way of a extraction device 10. In contrast to the drum-based devices known from the state of the art of the same performance class, the invention disclosed here has the advantage that it has a comparatively simple construction. Even the helical section 6 of the guide means 3, when required, may also be designed as a repetitive section. The length of the conveyor-technology device 1 is furthermore not limited by those bearing problems which burden the state of the art since the guide means demands no central axial bearing.

Figure 3:
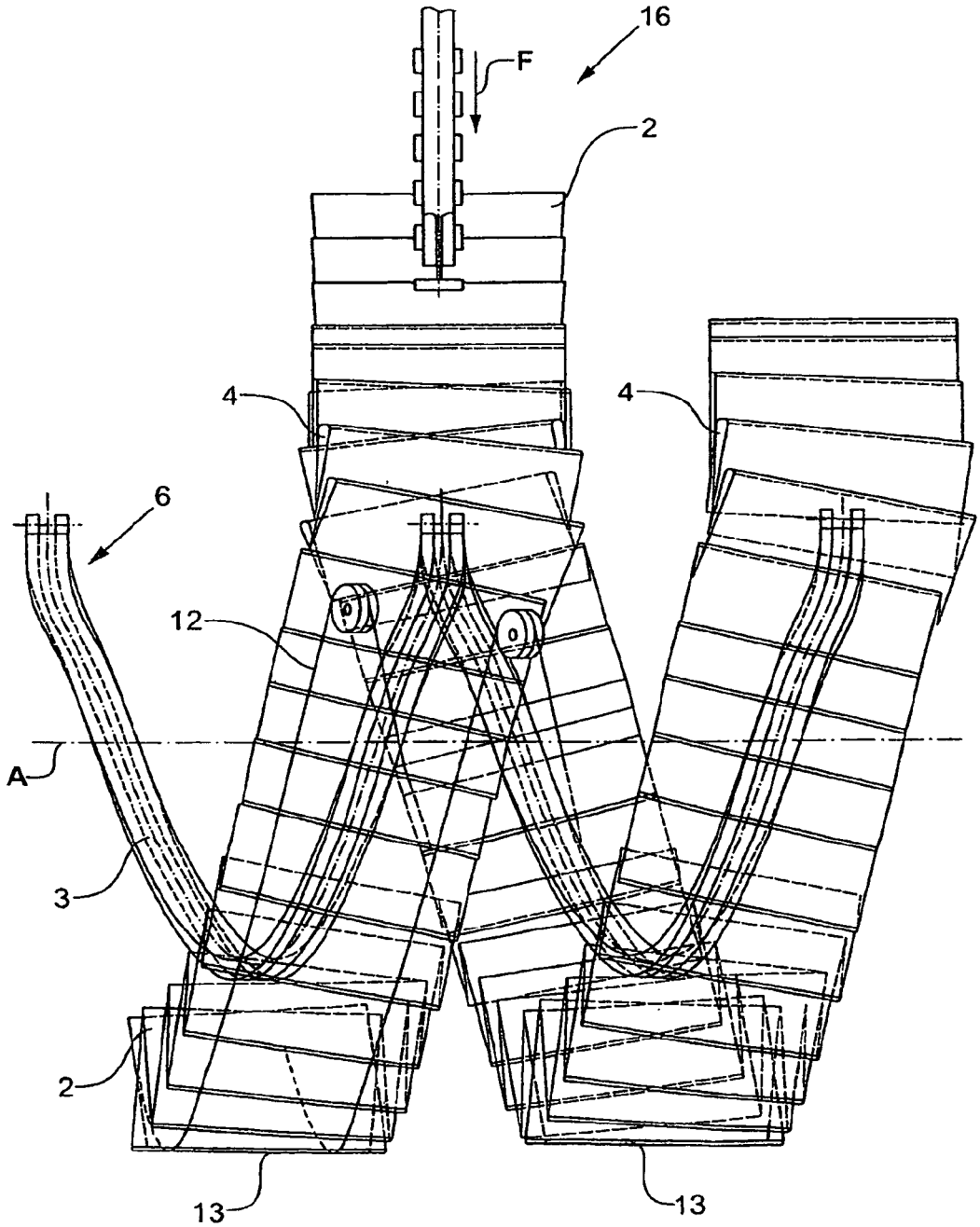
FIG. 3 is a cut-out of the conveyor-technology device according to FIG. 2.

FIG. 3 schematically shows a cut-out of the essentially helical section 6 of FIG. 2 in a lateral view. The guide means 3 has a spiral design with a variable pitch. In particular in the region of the feed conveyors 16 (only one is shown), the guide means 3 has an alignment which is matched to the conveyor direction F of the feed conveyors 16. With the shown embodiment, the guide means 3 in the region of the feed conveyors has no axial pitch but runs in an essentially tangential plane or perpendicular to the helix axis A. By way of the spatial curvature and alignment of the guide means 3 in the longitudinal direction A, the position and alignment of the conveyor means 4 may be adapted in an optimal manner. In the region of the feed conveyors 16 the guide means 3 has a straight, convex or concave shape which is matched to an optimised transfer of the supplied printed products. E.g. there exists the possibility of leading the conveyor means 4 in the region of the feed conveyors 16 on a straight line. In contrast to the devices known from the state of the art which are based on a drum-like or bucket-wheel device, the functioning principle disclosed here permits a very simple adaptability of the conveyor-technology device to external, above all spatial conditions. The conveyor means 4 and with it the printed products are led on flowing paths without disadvantageous deflections. Sudden changes in direction as are unavoidable with certain devices known from the state of the art do not burden the device according to the invention. As a result of the preferably modular construction, the device 1 may be infinitely expanded or supplemented when required.

With the conveyor fed printed products 2 it is the case of folded sheets 2. These are held by a multitude of conveyor means 4 such that their narrow sides run essentially parallel to the spiral path 6. When required it is also possible to align the printed sheets 2 such that their fold lines in each case are aligned parallel to the spiral axis A. This is preferably achieved in that the conveyor elements are connected in a rotatable or pivotable manner. Here one may in particular provide separating elements which are suspended separately or which may be connected to the conveyor elements 4.

The printed products 2 are temporarily fixed in the lower region of the spiral 6 by way of holding means 12 so that they do not inadvertently fall from the conveyor means 4. The holding means 12 as shown, are either external elements or they are part of the conveyor means 4 (clamping elements, bow/clips, flaps). Combinations are also possible. With the shown holding means 12 it is the case of revolving tapes or belts which are elastically tensioned via the saddles 13 of the conveyor means 4, and thus prevent the printed products 4 from falling from these. A lateral limitation results on account of the conveyor elements 4 themselves or by way of further means, e.g. separating plates, etc. (cf. FIG. 4).

Figure 4:
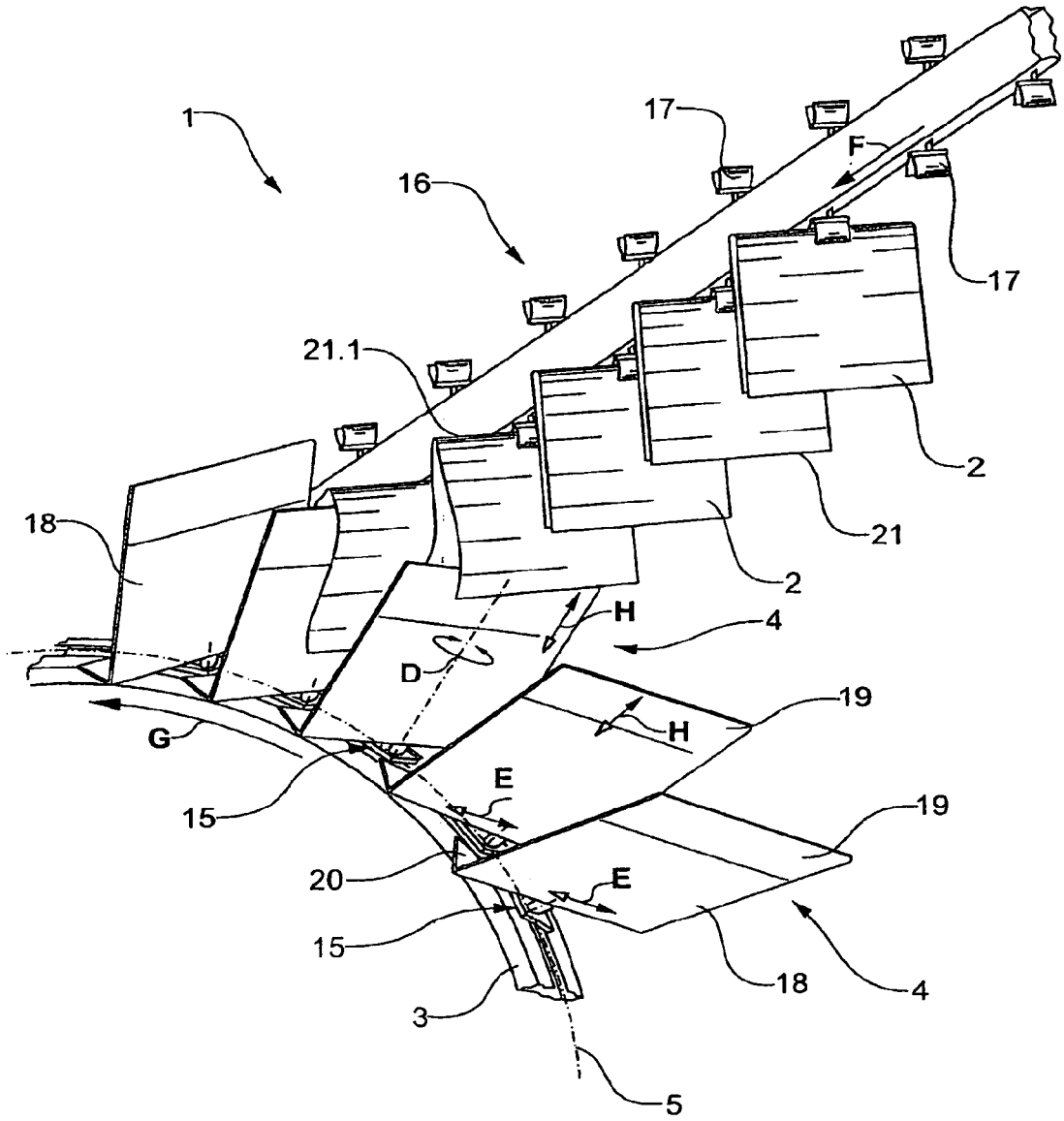
FIG. 4 is a cut-out of a second embodiment form of a conveyor-technology device according to the invention.

FIG. 4 shows a part of a further embodiment of a conveyor-technology device 1 in the region of a feed conveyor 16. A section of a guide means 3 formed essentially helically is shown in a perspective representation. The further course of the guide means 3 is illustrated by a dashed line. The guide means 3 is a spatially curved guide channel 3 which has a C-shaped cross section. The conveyor means 4 in their region lying opposite their saddles are held by bearing means 15 which is arranged in the inside of the guide channel 3 and which serves for the mounting and guiding of the conveyor means 4 (inner runner). With the shown embodiment form, the bearing means are in the manner of chain links and are actively connected to one another in the conveyor direction G so that they simultaneously serve for transmitting the drive force. The bearing means 15 are guided opposite the guide channel 3 by way of roller bearings, ball bearings or sliding bearings. The alignment of the guide channel 3 largely determines the alignment of the conveyor means 4 and thus of the printed products 2 located thereon.

With the shown embodiment the conveyor means 4 comprise a separating plate 18 which is held at the lower end by way of a bearing means 15. The separating plates 18 serve for the lateral guiding of the printed products, in particular when these are transported head-over. The separating plates 18 are arranged essentially perpendicularly to the guide means 3 and at the upper end in each case comprise a saddle for receiving printed products in an astride manner. A rim 20 which alternatively or supplementarily serves for the accommodation of the collated and/or inserted printed products (not shown in more detail) is located at the lower end of each separating plate 18. The conveyor means 4 when required comprises clamps or other internal or external means which prevent the gathered, inserted or collated printed products from falling out. Internal clamping means are e.g. actuated in a manner controlled e.g. by way of slotted guides.

Folded sheets 2 are fed in the conveyor direction by way of the grippers 17 of a feed conveyor 16. Alternative feed conveyor methods are possible. The printed sheets 2 are held by the grippers 17 at the fold 21.1 and are moved with a hanging cut-edge side 21 in the direction of the conveyor means 4. The separating plates 18 are guided along the guide means 3 such that by way of lateral insertion between the two side parts of the folded printed product 2 forming the flower 21, they engage with the printed products and open these. The device is preferably designed such that it engages on any existing prior fold. Alternatively or to supplement this, one may also provide means for opening multi-layered printed products. If required there also exists the possibility of arranging the conveyor means 4 in a laterally displaceable (cf. arrow E) or vertically displaceable (cf. arrow H) manner, or rotatably about a vertical axis D, in order achieve an optimal processing. The device 1 may be set to different formats of printed products by way of a vertical adjustability of the distance of the saddle 19 with respect to the rim 20 or the grippers 17 of the feed conveyor 16, the device 1 may be set to different formats of printed products.

Figure 5:
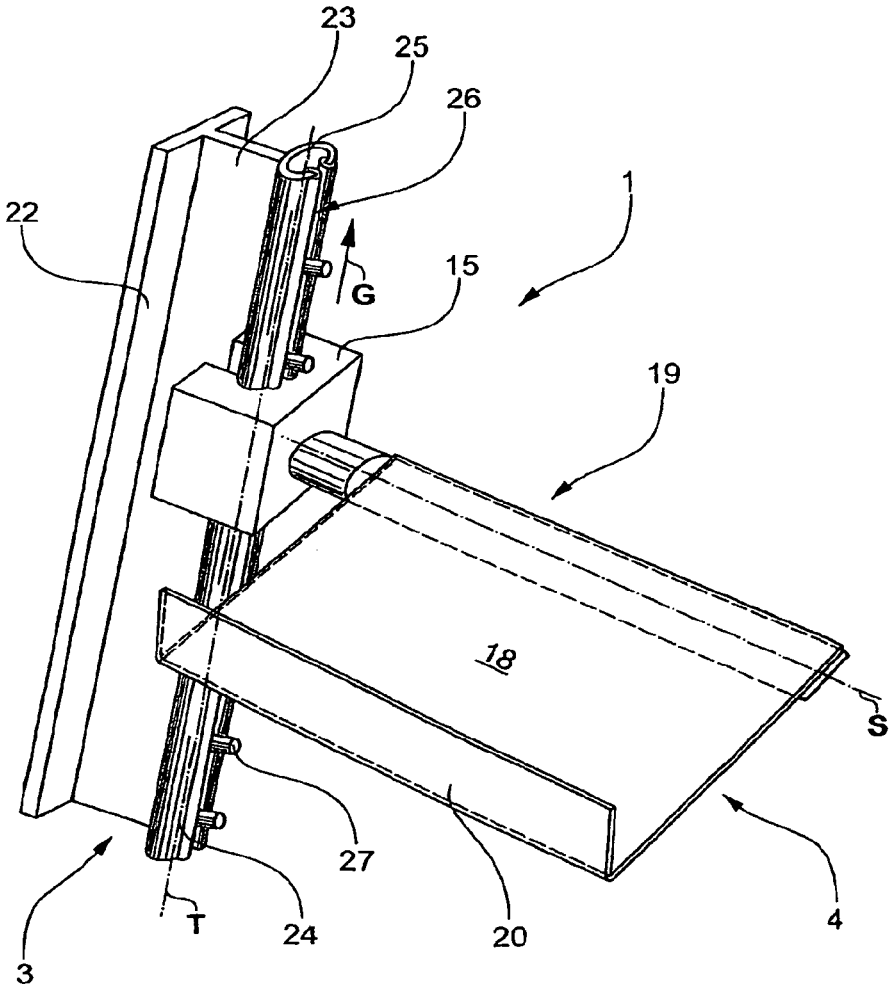
FIG. 5 is a cut-out of a third embodiment form of a conveyor-technology device according to the invention.

FIG. 5 shows a cutout of a further embodiment of a conveying-technology device 1. The conveyor means 4 comprise a separating plate 18 with a saddle 19 and an opposite rim 20. The conveyor means 4 here, laterally in the region of the saddle 10, is connected to a bearing means 15 which engages around a rail-like guide means 21. The guide rail 21 comprises a foot plate 22, a web 23 and a slotted guide tube 24. The outer surfaces of the web 23 and of the guide tube 24 serve as a guide surface for the bearing means 15. The bearing means 15 is displaceably mounted along the guide means 21. A drive means 25 is present in the inside of the guide tube 24 and serves for driving the conveyor means 4. The guide tube 24 comprises a longitudinally running slot-like opening 26 in which pegs 27 of a drive means 25 are arranged. The pegs 27 serve for transmitting a drive force to the conveyor means 4. With the drive means 25 it is the case of a revolving conveyor member in the form of a chain or cable. The drive force is transmitted onto the conveyor means 4 by way of a mechanical engagement. The conveyor means 4 may be flexibly coupled and decoupled to and from the guide means.

The conveyor means 4, at least with certain embodiments, are movably arranged about a first and/or second axis S, T, so that they meet the demands with regard to the angle and alignment. The alignment with respect to at least one of the two axes S, T may be determined e.g. by the guide means 21, in a forcibly controlled manner, or by way of external forces, e.g. gravity, centrifugal force or reaction forces. E.g. there exists the possibility of designing the conveyor means 4 such that these align themselves by way of gravity. By way of a suitable design and arrangement of the guide means 3, in particular by way of individually actively aligning the conveyor means 4 about the longitudinal axis T of the guide means 3, one achieves a high packing density without the individual conveyor means 4 mutually obstructing one another. By way of the rotation of the guide means 3 about its longitudinal axis T, one may define the local alignment of the conveyor means 4 with respect to the guide means 3 or the ground. With conveyor means 4 which align themselves due to gravity, then guide means 3 running vertically upwards under certain conditions have a negative effect on the packing density. An individual alignment of the conveyor means 4 about the longitudinal axis T of the guide means 3 may reduce this problem.

Figure 6:
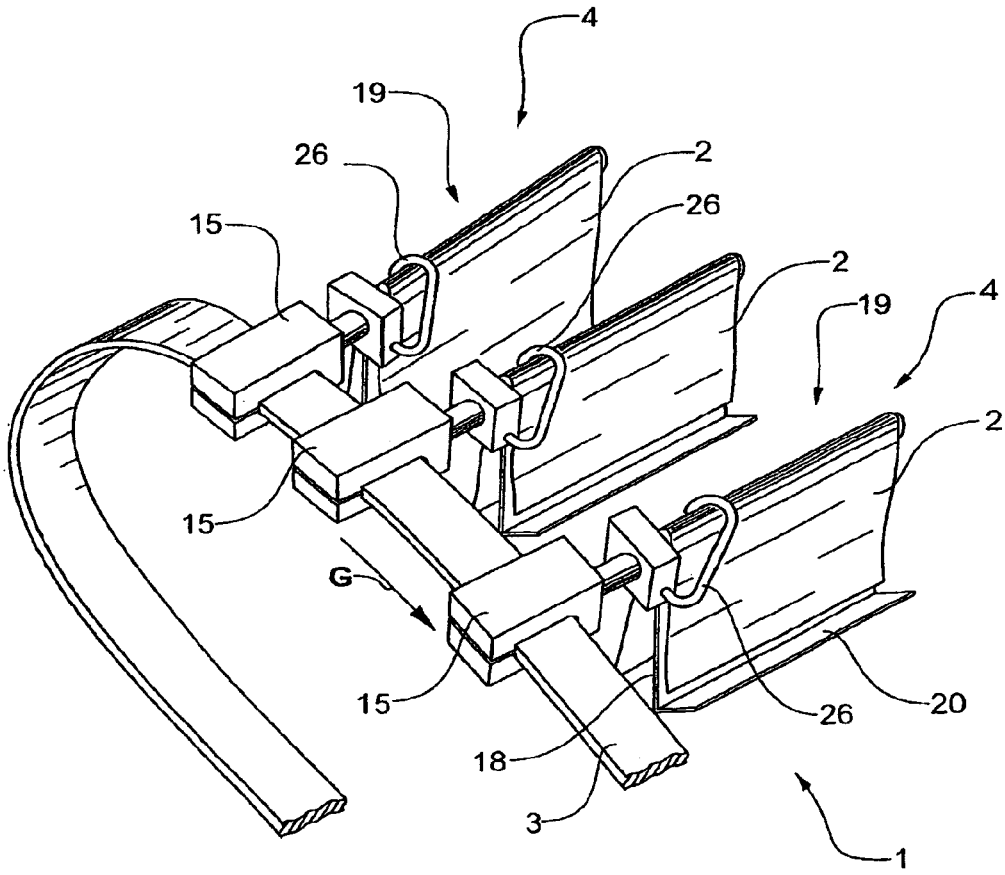
FIG. 6 is a cut-out of a fourth embodiment form of a conveyor-technology device according to the invention.

FIG. 6 as a cut-out shows a further embodiment of a conveyor-technology device 1. The conveyor means 4 are actively connected to a rail-like guide means 3 and comprise a drive in the form of a motor (not shown in more detail). The conveyor means 4 are individually displaceable and thus permit a flexible processing and collecting of the end products.

As drives, one preferably applies inexpensive linear motors which have no moving parts but produce their drive force by way of piezoelectrically activated oscillation elements and by way of suitable frequency-dependent oscillation patterns in the ultrasound region. The drive energy and the control commands are preferably transmitted in the low voltage region via the guide rails 21.

The conveyor means 4 comprise a separating plate 18 with a saddle 19 and a rim 20 and are held in a lateral manner. Printed products 2 located on the conveyor means 4 are fixed by way of holding means in the form of bow-like clamping means 26.

Figure 7:
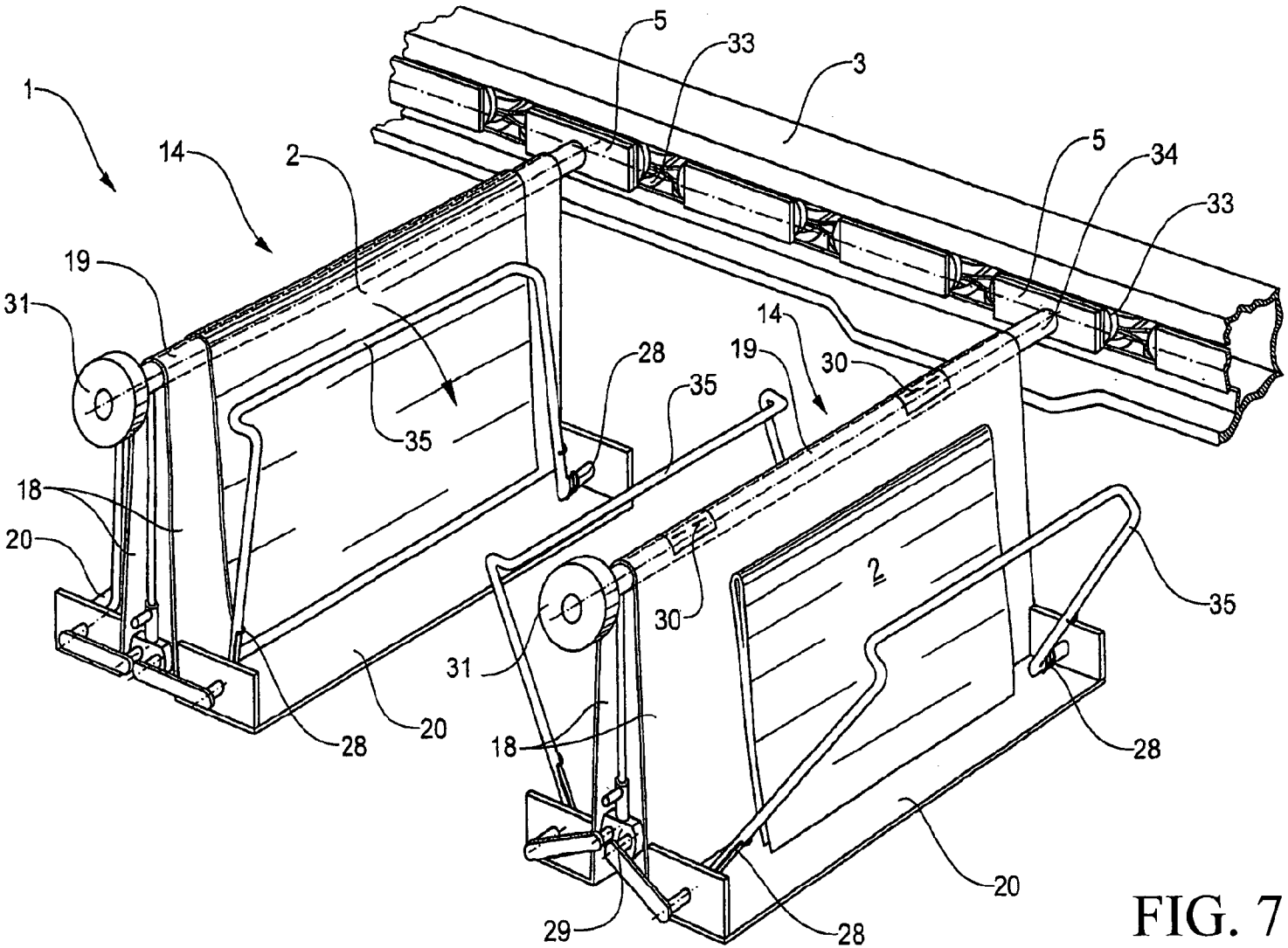
FIG. 7 is a cut-out of a fifth embodiment form of a conveyor-technology device according to the invention.

FIG. 7 shows a section of a conveyor-technology device 1. Bearing means 15 mounted in two spatial directions are arranged in the inside of a one-celled guide channel 3 by way of rollers 33, and these bearing means are displaceable along the guide channel 3. Holding rods 34 are arranged on the bearing means 15 and serve the holding of a carrier element 14. The carrier element 14 comprises a saddle 19 and a separating plate 18 which extends to both its sides. At the end lying opposite the saddle 19, each separating plate 18 comprises a rim 20 which may be used for collating or gathering printed products 2 and may be designed adjustable in height, distance and alignment, in particular with respect to the guide means 3. Holding means in the form of bows 35 are arranged in a laterally extendable manner and serve for the temporary retention of printed products 2 arranged on the carrier element 14 or the saddle 19 by way of pressing these against the separating elements 14 by way of springs 28. The bows 35 may be laterally extended by way of a lever mechanism 29. In the extended position the bows 35 preferably have a funnellike characteristic which positively supports the accommodation of printed products 2. Instead of a bow-like design, the holding means 35 may also be designed in a two-dimensional manner (e.g. sheet metal part) and completely or partly encompass the printed products 2, or may have several interactive points with these. A bend-up device 30 is arranged in the region of the saddle 19, said bend-up device serving for bending up staples (not shown in more detail). The bend-up device is preferably adjustably arranged with respect to the saddle. A guide roller 31 which serves for supporting and guiding the carrier element 4 is arranged at the outer end of the saddle 19. The holding means 15 and/or the bend-up device 30 are preferably controlled via involutes. The conveyor means 4 are preferably designed in a manner which is independent of the format. Further embodiments result for the man skilled in the art by way of a combination of the features of the described embodiments.

We claim:

1. A method for processing printed products, the method comprising the steps of:

feeding printed products to a plurality of conveying conveyor means by means of feed conveyors;

temporary fixing said printed products by means of holding means functionally connected to the conveyor means such that printed products are conveyable against the effect of gravity and such that the printed products remain in their position relative to their dedicated conveyor means during the conveying process;

conveying the conveyor means along a spatially curved guide with an essentially helical section to an active region of at least one processing station;

processing the printed products at the least one processing station.

2. A method according to claim 1, wherein the conveyor means at least in regions is rotated spatially about an axis by at least 180° and thereafter is led past by at least one processing station and subsequently the printed products are removed from the conveyor means.

* * * * *